US007249989B2

(12) United States Patent
Hayama

(10) Patent No.: US 7,249,989 B2
(45) **Date of Patent: *Jul. 31, 2007**

(54) METHOD OF MANUFACTURING AN ENVELOPE AND METHOD OF MANUFACTURING AN ELECTRON BEAM APPARATUS

(75) Inventor: Akira Hayama, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 11/418,026

(22) Filed: May 5, 2006

(65) Prior Publication Data

US 2006/0205314 A1 Sep. 14, 2006

Related U.S. Application Data

(62) Division of application No. 10/693,872, filed on Oct. 28, 2003, now Pat. No. 7,063,585.

(30) Foreign Application Priority Data

Oct. 30, 2002 (JP) ..... 2002-316180

(51) Int. Cl.
*H01J 9/00* (2006.01)
*H01J 9/26* (2006.01)

(52) U.S. Cl. ..... 445/25; 445/24

(58) Field of Classification Search ..... 445/24, 445/25

See application file for complete search history.

(56) References Cited

U.S. PATENT DOCUMENTS

| | | | | |
|---|---|---|---|---|
| 5,083,058 | A | 1/1992 | Nonomura et al. | 313/482 |
| 5,760,538 | A | 6/1998 | Mitsutake et al. | 313/422 |
| 6,278,066 | B1 | 8/2001 | Fahlen et al. | 174/250 |
| 6,571,464 | B2 | 6/2003 | Fahlen et al. | 29/825 |
| 6,617,772 | B1 | 9/2003 | Barton et al. | 313/292 |
| 6,802,753 | B1 | 10/2004 | Ando et al. | 445/6 |
| 7,063,585 | B2 * | 6/2006 | Hayama | 445/24 |
| 2004/0113540 | A1 | 6/2004 | Niibori et al. | 313/495 |

FOREIGN PATENT DOCUMENTS

| | | |
|---|---|---|
| EP | 0 405 262 A1 | 1/1991 |
| EP | 0 690 472 A1 | 1/1996 |

(Continued)

OTHER PUBLICATIONS

Elinson, M.I., et al., "The Emission of Hot Electrons and the Field Emission of Electrons from Tin Oxide", Radio Engineering and Electronic Physics, No. 7, pp. 1290-1296, Jul. 1965.

*Primary Examiner*—Mariceli Santiago
(74) *Attorney, Agent, or Firm*—Fitzpatrick, Cella, Harper & Scinto

(57) ABSTRACT

Each of spacers which defines an interval between substrates composing an envelope is fixed to the substrates while their linearity is kept by the tension exerted therein. In the fixation, it is set such that a fixing point of each of the spacers is located between points on which the tension is exerted. Thus, even when the tension is released, the linearity is maintained, so that a displacement of each of the spacers can be prevented to kept a high assembly accuracy.

7 Claims, 8 Drawing Sheets

FOREIGN PATENT DOCUMENTS

| | | |
|---|---|---|
| JP | 3-49135 | 3/1991 |
| JP | 8-180821 | 7/1996 |
| JP | 2000-057979 | 2/2000 |
| JP | 2000-133172 | 5/2000 |
| JP | 2000-510282 | 8/2000 |
| JP | 2000-323073 | 11/2000 |
| JP | 2001-252779 | 9/2001 |
| JP | 2003-282003 | 10/2003 |
| WO | WO 98/28774 | 7/1998 |

* cited by examiner

METHOD OF MANUFACTURING AN ENVELOPE AND METHOD OF MANUFACTURING AN ELECTRON BEAM APPARATUS

This application is a division of U.S. application Ser. No. 10/693,872, filed Oct. 28, 2003 now U.S. Pat. No. 7,063, 585.

BACKGROUND OF THE INVENTION

1. Field of the Invention

The present invention relates to a method of manufacturing an envelope used for an image display device and a method of manufacturing an electron beam apparatus that emits electrons and is used therefor.

2. Related Background Art

Up to now, two types of devices, namely, a hot cathode device and a cold cathode device have been known as electron-emitting devices in the electron beam apparatus used for the image display device, for example.

With respect to the cold cathode device of the two types, one disclosed in, for example, M. I. Elinson, Radio Eng. Electron Phys., 10, p. 1290 (1965) and another one described later have been known as surface conduction electron-emitting devices. In addition, a field emission type device (hereinafter referred to as FE-type device), a metal/insulating-layer/metal type device (hereinafter referred to as MIM type device), and the like have been known.

The surface conduction electron-emitting device utilizes a phenomenon that electron emission is produced by allowing a current to flow into a thin film of a small area, which is formed on a substrate, in a direction parallel to the surface of the thin film.

Of image display devices using the above-mentioned electron-emitting devices, a flat display device which is thin is space-saving and light. Accordingly, the flat display device is focused as a substitute for a cathode ray tube display device.

FIG. 8 is a perspective view showing an example of a display panel unit composing a flat image display device. In FIG. 8, a portion of the display panel is cut to show an internal structure.

The flat image display device has a structure in which a rear plate 115 above which a plurality of cold cathode devices 112 are formed and a face plate 117 on which a fluorescent film 118 as a light emitting material is formed are opposed to each other through a structural support member 120 which is a space defining member (which is called a spacer or a rib). An airtight envelope that maintains the inner portion of the display panel in a vacuum is composed of the rear plate 115, a side wall 116, and the face plate 117. A substrate 111 is fixed onto the rear plate 115. The plurality of cold cathode devices 112 are formed on the substrate 111. In addition, a metal back 19 which is known in a CRT field is provided on the surface of the fluorescent film 118 on the rear plate 115 side.

Also, the inner portion of the above-mentioned airtight envelope is maintained at the degree of vacuum of about $10^{-6}$ [Torr]. In the case where a display area of the image display device increases, it is necessary to use a method of preventing a deformation or a breakage with respect to the rear plate 115 and the face plate 117, resulting from a pressure difference between the inside and the outside of the airtight envelope. In the case of adopting a method of thickening the rear plate 115 and the face plate 117, the weight of the image display device increases. In addition, when a screen is viewed from an oblique direction, a distortion of an image and a parallax are caused. In contrast to this, the spacers 120, each of which is made of a relatively thin glass plate and resistant to an atmospheric pressure are provided. A method of assembling the spacers 120 is described in, for example, U.S. Pat. No. 6,278,066 (WO98/28774, Japanese Patent Application Laid-Open No. 2000-510282), EP 690472 A (Japanese Patent Application Laid-Open No. H08-180821), and EP 405262 A (Japanese Patent Application Laid-Open No. H03-049135). Accordingly, an interval between the rear plate 115 and the face plate 117 on which the fluorescent film 118 is formed is generally kept on the order of submillimeter or to several millimeters. As described above, the inner portion of the airtight envelope is maintained at a high vacuum.

Also, the spacer 120 should not affect significantly a trajectory of an electron flying between the rear plate 115 and the face plate 117. Charging of the spacer 120 is one of causes which affect the electron trajectory. It is considered that a part of electrons emitted from an electron source or electrons reflected by the face plate 117 are incident in the spacer 120 and a secondary electron is emitted from the spacer 120, or ions ionized by collision of the electrons deposit on the surface of the spacer 120, with the result that the charging of the spacer 120 occurs.

In the case in which the spacer 120 is charged positively, since the electrons flying in the vicinity of the spacer 120 are attracted to the spacer, distortion occurs on a displayed image in the vicinity of the spacer 120. Such an influence of the charging becomes more conspicuous in accordance with increase in a space between the rear plate 115 and the face plate 117.

As a method of controlling charging in general, there is a method of removing charges by giving conductivity to a charged surface and causing a slight amount of electric current to flow to the spacer. The concept of this method is applied to the spacer 120, and EP 690472 A discloses a technique for coating a surface of the spacer 120 with a semiconductive film.

In addition, EP 405262 A discloses a technique for coating the surface of the spacer 120 with a PdO glass material.

In addition, breakage of the spacer 120 due to connection failure or concentration of electric currents can be prevented by applying an electric field to the above-mentioned coating material uniformly through the formation of an electrode in a contact surface of the spacer 120 with the face plate 115 and the rear plate 117.

In the image display device using the display panel described above, when voltages are applied to the respective cold cathode devices 112 through external envelope terminals Dx1 to Dxm of row-directional wirings 113 and external envelope terminals Dy1 to Dyn of column-directional wirings 114, electrons are emitted from the respective cold cathode devices 112. Simultaneously with this, a high voltage of several hundred volts to several kilovolts is applied to the metal back 119 through an external envelope terminal Hv to accelerate the emitted electrons, so that the electrons collide with the inside surface of the face plate 117. Thus, respective color phosphors composing the fluorescent film 118 are excited to emit lights, thereby displaying an image.

In the display panel of the image display device which is described in the conventional example, a plurality of spacers are arranged according to a display area of the display panel, a thickness of the rear plate, and a thickness of the face plate. However, in the case where the display area increases, the number of spacers increases and a time required to arrange the spacers on the display panel in a assembling process lengthens, so that a cost is increased. In addition, the degree of influence of a yield of the spacer in the assembly on a yield of the display panel increases and this causes an increase in a cost.

Further, in the case where the spacers are located outside a non-light-emitting region of the face plate because the assembly accuracy of the spacers is insufficient, a display image is influenced by the spacers, thereby making it difficult to display a high quality image. In addition, even if the spacers are located inside the non-light-emitting region, in the case where the spacers are misaligned because the assembly accuracy is insufficient, the spacers influences an electron beam trajectory, thereby distorting an image in some cases. In particular, this phenomenon is markedly exhibited in the case where the spacers are charged.

SUMMARY OF THE INVENTION

The present invention has been made with respect to a spacer assembling and manufacturing method capable of solving the above-mentioned problems. An object of the present invention is to improve an assembly accuracy by preventing displacements of the spacers and to enable manufacturing of an envelope or an electron beam apparatus for a high quality image display device at a low cost.

In order to solve the above-mentioned problems, according to the present invention, there is provided a method of manufacturing an envelope which includes a first substrate, a second substrate opposed to the first substrate, and a space defining member which is located between the first substrate and the second substrate and has a substantially plate shape, the method including:

applying a tension to the space defining member;

fixing the space defining member to which the tension is applied to the first substrate; and releasing the tension from the interval specifying member fixed to the first substrate, in which in the fixing of the space defining member to the first substrate, a fixing point of the space defining member to the first substrate is located between points at which the tension is exerted.

Further, in the method of manufacturing an envelope according to the present invention, in the applying of the tension to the space defining member, a base of the space defining member is located at the point at which the tension is exerted.

Further, in the method of manufacturing an envelope according to the present invention, in the applying of the tension to the space defining member, an auxiliary support member connected with a base of the space defining member is located at the point at which the tension is exerted.

Further, in the method of manufacturing an envelope according to the present invention, in the applying of the tension to the space defining member, the tension is applied by a spacer conveying unit.

Further, in the method of manufacturing an envelope according to the present invention, in the applying of the tension to the space defining member, the tension is applied by a tension applying unit.

Further, according to the present invention, there is provided a method of manufacturing an electron beam apparatus which includes a first substrate having a plurality of electron-emitting devices on a surface thereof, a second substrate which is opposed to the first substrate and in which an electrode that controls electrons emitted from the plurality of electron-emitting devices is provided, and at least one space defining member which is located between the first substrate and the second substrate and has a substantially plate shape, the method including:

applying a tension to the interval specifying member;

fixing the space defining member to which the tension is applied to the first substrate; and releasing the tension from the space defining member fixed to the first substrate, in which in the fixing of the space defining member to the first substrate, a fixing point of the space defining member to the first substrate is located between points at which the tension is exerted.

Further, in the method of manufacturing an electron beam apparatus according to the present invention, in the applying of the tension to the space defining member, a base of the space defining member is located at the action point of the tension.

Further, in the method of manufacturing an electron beam apparatus according to the present invention, in the applying of the tension to the space defining member, an auxiliary support member connected with a base of the space defining member is located at the action point of the tension.

Further, in the method of manufacturing an electron beam apparatus according to the present invention, in the applying of the tension to the space defining member, the tension is applied by a spacer conveying unit.

Further, in the method of manufacturing an electron beam apparatus according to the present invention, in the applying of the tension to the space defining member, the tension is applied by a tension applying unit.

Further, in the method of manufacturing an electron beam apparatus according to the present invention, the space defining member has a base of an insulating property.

Further, in the method of manufacturing an electron beam apparatus according to the present invention, the space defining member has a surface on which a high resistance film is formed.

Further, in the method of manufacturing an electron beam apparatus according to the present invention, the high resistance film has a sheet resistance of $10^7$ [Ω/square] or more and $10^{14}$ [Ω/square] or less.

Further, in the method of manufacturing an electron beam apparatus according to the present invention, the first substrate further includes a plurality of wirings that electrically connect the plurality of electron-emitting devices and the space defining members are located on the wiring.

DETAILED DESCRIPTION OF THE PREFERRED EMBODIMENTS

The present invention relates to a method of manufacturing an envelope or an electron beam apparatus in which spacers are assembled on a substrate. Hereinafter, preferred embodiment modes of the present invention will be described.

Figure 4:
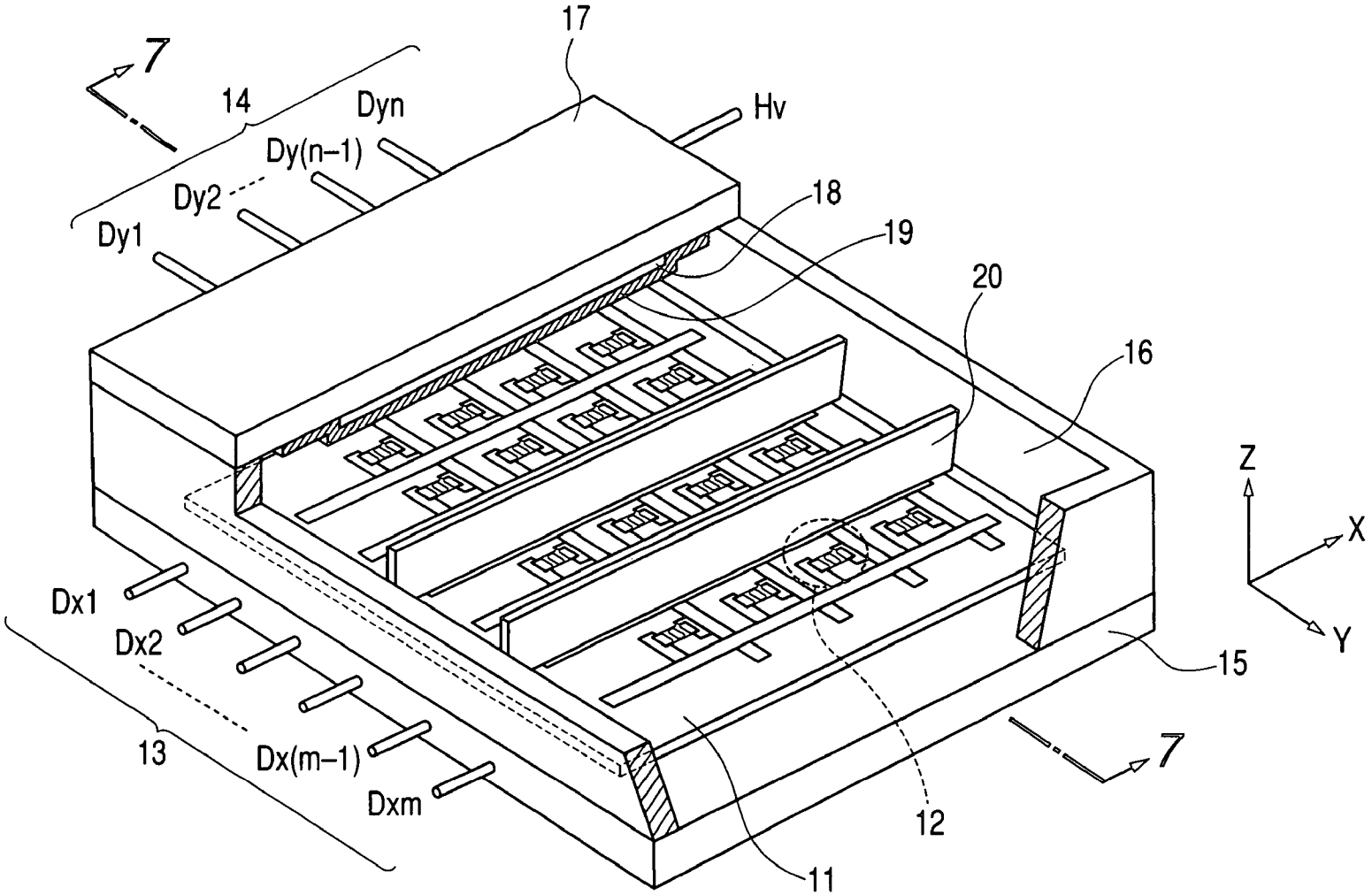
FIG. 4 is a perspective view showing a display panel of an image display device using the spacers, in which a portion of the display panel is cut, according to the present invention.

Note that, as shown in FIG. 4 (described later in detail), a display panel of an image display device using the spacers according to the present invention is a flat display device having a structure in which a rear plate 15 above which a plurality of cold cathode devices 12 are formed and a face plate 17 on which a fluorescent film 18 as a light emitting material is formed are opposed to each other through spacers 20.

FIGS. 1A, 1B, 1C, 1D, and 1E are schematic views showing a structure of a spacer and a spacer manufacturing method according to a first embodiment mode, which are explanatory views showing a process for assembling the spacer 20 onto the rear plate 15.

(a) The spacer 20 is set to a spacer conveying unit 1.

The spacer conveying unit 1 is provided with spacer grasping portions 2. A dispenser for adhesive application (not shown) and a heat gun for heat air drying (not shown) are located in the spacer conveying unit 1.

Each of the spacer grasping portions 2 is composed of a reference claw 3 and a movable claw 4. The reference claw 3 and the movable claw 4 increase or decrease their interspace by moving the movable claw 4, thereby grasping the spacer 20. In addition, in order to prevent the breakage of the spacer 20 at the time of grasping the spacer 20, the surfaces of right and left reference claws 3, which are in contact with the spacer 20 are adjusted such that the surfaces thereof are parallel with each other and distances from an apparatus origin to the positions of the surfaces are equal to each other.

(b) Tension is applied to the spacer 20 in the longitudinal direction thereof.

Figure 1A:
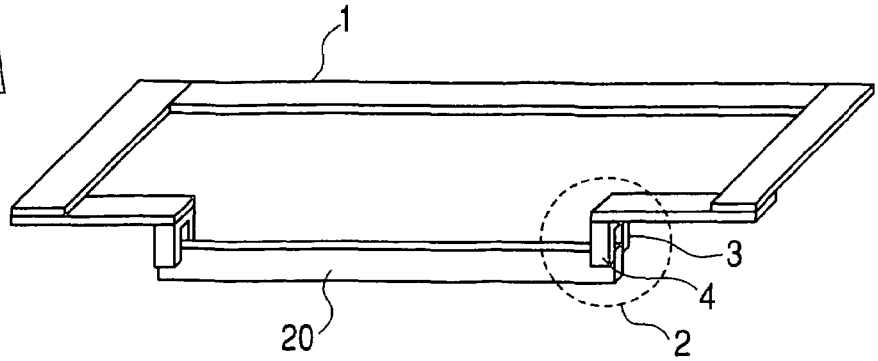
FIGS. 1A, 1B, 1C, 1D, and 1E are schematic views showing a structure of a spacer and a spacer manufacturing method according to a first embodiment mode of the present invention.
Figure 1B:
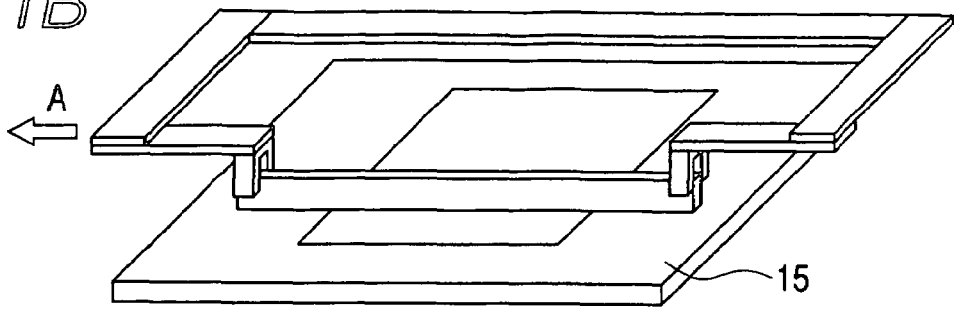
Figure 1C:
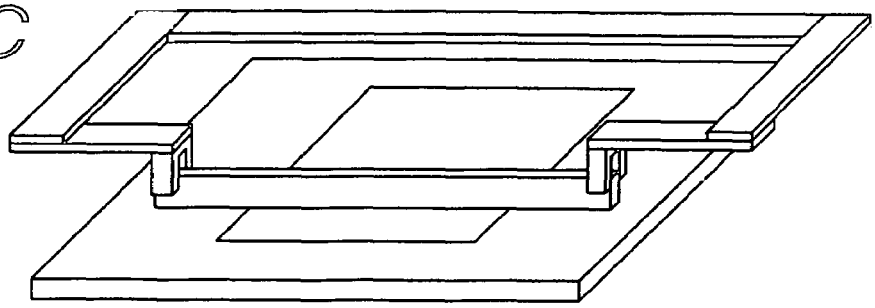
Figure 1D:
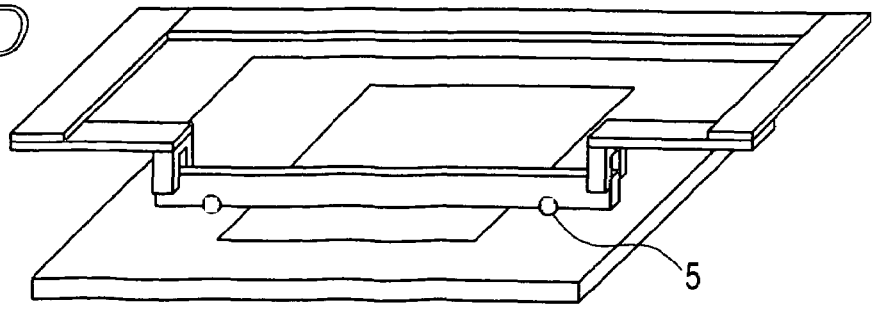
Figure 1E:
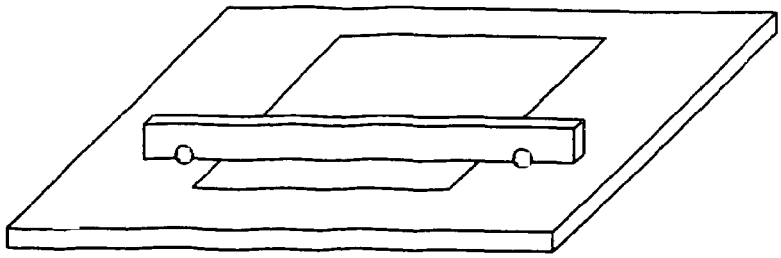
Figure 2A:
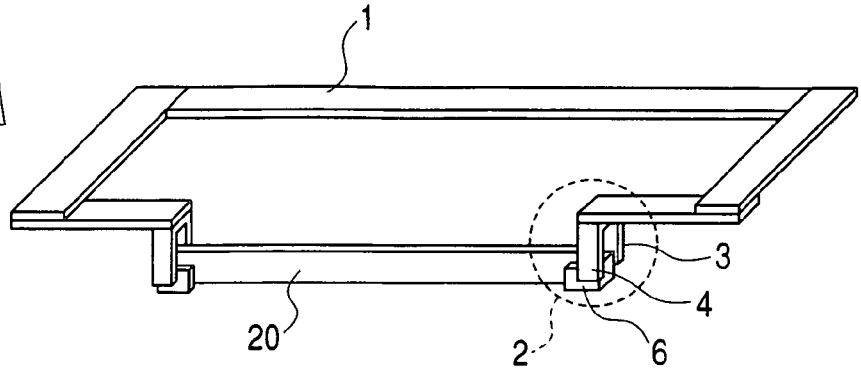
FIGS. 2A, 2B, 2C, 2D, and 2E are schematic views showing a structure of a spacer and a spacer manufacturing method according to a second embodiment mode of the present invention.
Figure 2B:
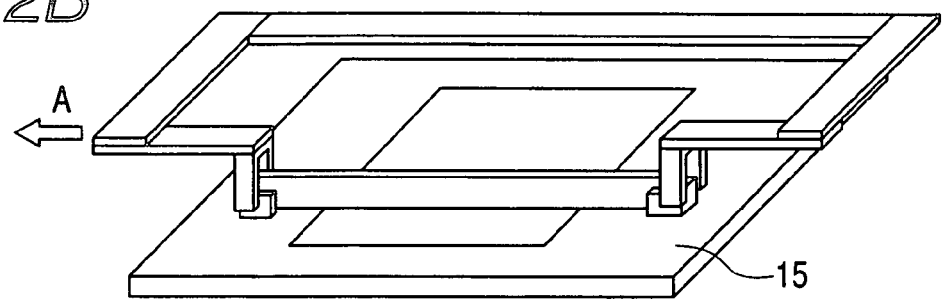
Figure 2C:
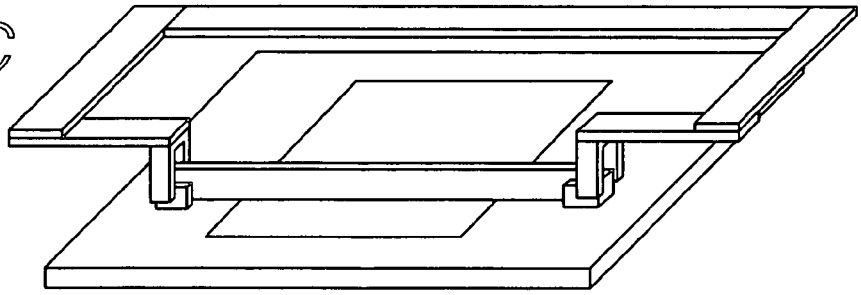
Figure 2D:
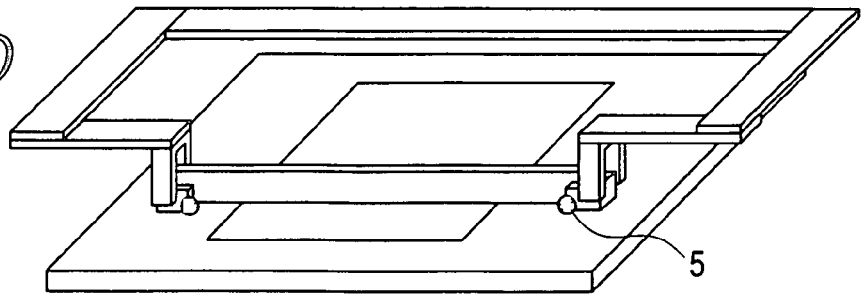
Figure 2E:
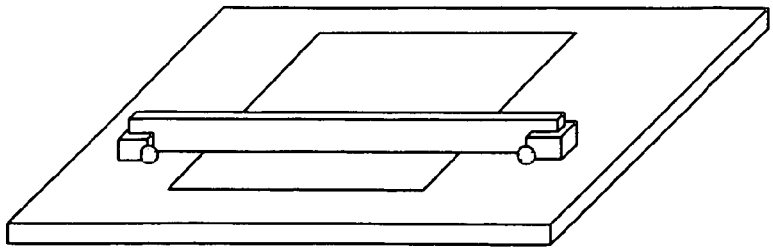

One of the spacer grasping portions 2 is fixed and the other thereof is movable in a direction indicated by an arrow "A" in FIG. 1B. The reference claw 3 and the movable claw 4 approach each other leaving no space therebetween to grasp the spacer 20, and then one of the spacer grasping portions 2 is pressed in the longitudinal direction of the spacer 20 by using an air cylinder, so that the spacer 20 is pulled to produce a tension.

(c) The spacer 20 is aligned to a desirable location on the rear plate 15.

(d) The spacer 20 is fixed to the rear plate 15.

The right amount of adhesive 5 is applied using a dispenser, and then the adhesive 5 is heated by hot air from the heat gun and cured, so that the spacer 20 is fixed to the rear plate 15 by bonding in a state in which a predetermined positional relationship is kept. The location fixed by the adhesive 5 is set inside the point to which the tension is applied. Here, it is desirable that the used adhesive 5 is an adhesive in which degassing is less, such as an organic adhesive because the spacer 20 is finally used in a vacuum envelope.

(e) The tension to the spacer is released.

After curing of the adhesive 5 is completed, a pressure by the air cylinder of the spacer conveying unit 1 is released to move the movable claw 4 of the spacer grasping portion 2 in a direction in which the movable claw 4 is apart from the spacer 20, with the result that the spacer 20 fixed to the rear plate 15 is released from the spacer grasping portions 2.

As described above, a tension acting point of the spacer 20 is located outside the fixing point onto the rear plate 15. Therefore, the fixation of the spacer 20 onto the rear plate 15 is completed while the linearity owing to the tension is kept, so that the necessary and sufficient assembly accuracy of the spacer 20 can be obtained. If the tension action point of the spacer 20 is located inside the fixing point onto the rear plate 15, a correction effect of the linearity by the tension is not obtained in the region from the tension action point to the fixing point, so that the necessary and sufficient assembly accuracy of the spacer 20 cannot be obtained.

Further, because the tension action point of the spacer 20 is located outside the fixing point onto the rear plate 15, when the tension is released, the influence of force, which is applied to the spacer 20, on the spacer 20 can be eliminated.

Hereinafter, other embodiment modes of the present invention and effects will be described.

FIGS. 2A to 2E are schematic views showing a structure of a spacer and a spacer manufacturing method according to a second embodiment mode. As compared with the first embodiment mode, a structure of the spacer 20 is modified in this embodiment mode. Auxiliary support members 6 are bonded to the spacer 20 in both ends thereof by an adhesive. In this embodiment mode, the tension is applied to the auxiliary support members 6 or the spacer 20.

In this embodiment mode, the spacer 20 includes a spacer to which the auxiliary support members 6 are bonded.

FIGS. 3A to 3F are schematic views showing a structure of a spacer and a spacer manufacturing method according to a third embodiment mode. As compared with the first embodiment mode, a structure of the spacer 20 and a part of the assembling process are modified. The auxiliary support member 6 is bonded in advance to the spacer 20 in one end thereof by an adhesive.

(a) The spacer 20 is set to the spacer conveying unit 1.

The spacer conveying unit 1 is provided with the spacer grasping portions 2. A dispenser for adhesive application (not shown) and a heat gun for heat air drying (not shown) are located in the spacer conveying unit 1. Each of the spacer grasping portions 2 is composed of the reference claw 3 and the movable claw 4. The reference claw 3 and the movable claw 4 increase or decrease their interspace by moving the movable claw 4, thereby grasping the spacer 20. In addition, in order to prevent the breakage of the spacer 20 at the time of grasping the spacer 20, the surfaces of right and left reference claws 3, which are in contact with the spacer 20 are adjusted such that the surfaces thereof are parallel with each other and distances from an apparatus origin to the positions of the surfaces are equal to each other. In this step, grasping of the spacer 20 is conducted by grasping the spacer 20 or the auxiliary support members 6.

(b) The spacer 20 is aligned to a desirable location on the rear plate 15.

(c) One end of the spacer 20 is fixed to the rear plate 15.

The right amount of the adhesive 5 is applied using the dispenser, and then the adhesive 5 is heated by hot air from the heat gun and cured, so that the spacer 20 is fixed to the rear plate 15 by bonding in a state in which a predetermined positional relationship is kept. The location fixed by the adhesive 5 is the spacer 20 or the auxiliary support members 6.

(d) The tension is applied in the longitudinal direction of the spacer 20.

Figure 3A:
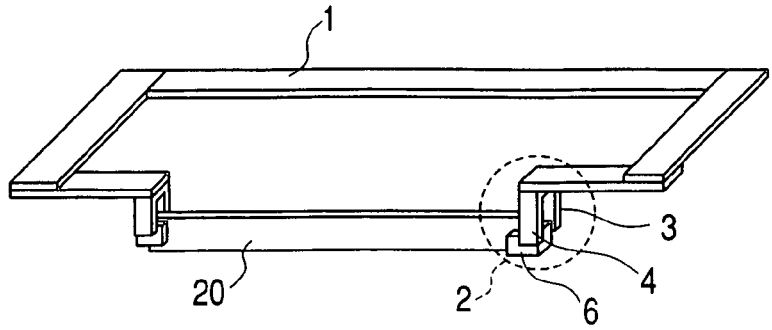
FIGS. 3A, 3B, 3C, 3D, 3E, and 3F are schematic views showing a structure of a spacer and a spacer manufacturing method according to a third embodiment mode of the present invention.
Figure 3B:
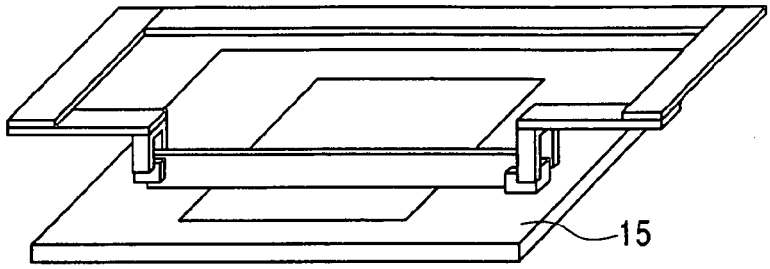
Figure 3C:
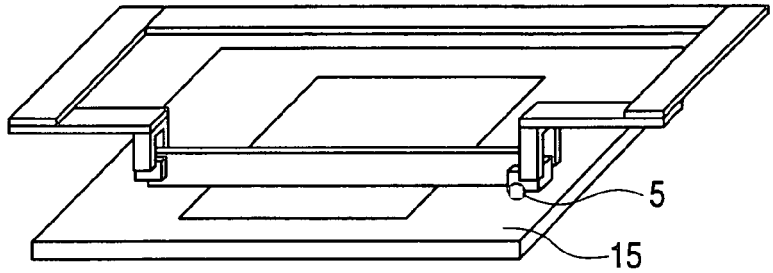
Figure 3D:
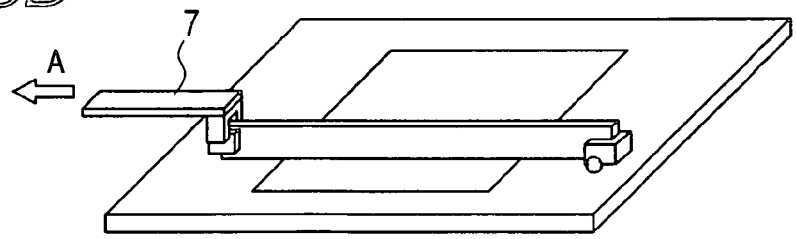
Figure 3E:
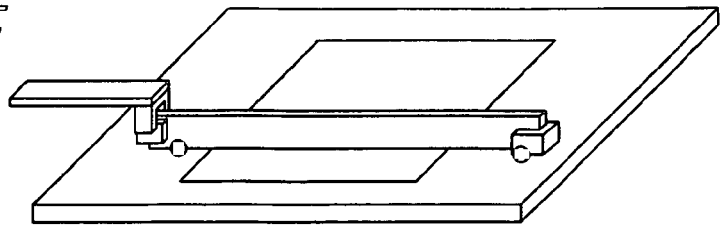
Figure 3F:
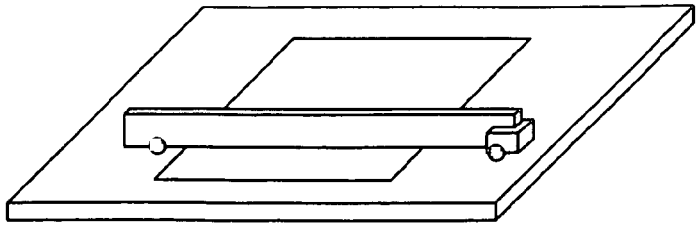

The end of the spacer 20, which is not fixed to the rear plate 15 is pulled using a tension applying unit 7 that grasps the spacer grasping portion 2 which is movable in the direction indicated by the arrow "A" of FIG. 3D as described in the first embodiment mode, with the result that the tension is produced in the spacer 20. In this step, as in the first embodiment mode, a method of applying the tension by the spacer grasping portion 2 of the spacer conveying unit 1 may be used.

(e) The spacer 20 is fixed to the rear plate 15.

In the same manner as the above, the spacer 20 is fixed to the rear plate 15 by bonding in a state in which a predetermined positional relationship is kept. The location fixed by the adhesive 5 is set inside the point to which the tension is applied.

(f) The tension to the spacer 20 is released.

After curing of the adhesive 5 is completed, a pressure by the air cylinder of the tension applying unit 7 is released to move the movable claw 4 of the spacer grasping portion 2 in a direction in which the movable claw 4 is apart from the spacer 20, with the result that the spacer 20 fixed to the rear plate 15 is released from the spacer grasping portions 2.

In the case of this embodiment mode, because it is unnecessary to apply the tension by the spacer conveying unit 1, a simple structure can be achieved as compared with the first embodiment mode. In addition, the size of the tension applying unit 7 can be reduced because the movable region thereof is only a region above the rear plate 15.

(Outline of Image Display Device)

Next, a structure of a display panel of an image display device to which the present invention is applied and a method of manufacturing the display panel will be described with reference to specific examples.

FIG. 4 is a perspective view showing a display panel of an image display device using spacers. A portion of the display panel is cut to show an internal structure thereof.

The display panel is a flat display device having a structure in which the rear plate 15 above which the plurality of cold cathode devices 12 are formed and the face plate 17 on which the fluorescent film 18 as a light emitting material is formed are opposed to each other through the spacers 20. An airtight envelope that maintains the inner portion of the display panel in a vacuum is composed of the rear plate 15, the side wall 16, and the face plate 17. In the case of assembling the airtight envelope, seal bonding is required for the bonding portions of respective members so as to keep sufficient strength and airtightness therein. For example, the seal bonding is achieved by applying a frit glass to the bonding portions and performing baking in an atmosphere or a nitrogen atmosphere at 400° C. to 500° C. for 10 minutes or longer. A method of exhausting the inner portion of the airtight envelope to produce a vacuum will be described later. In addition, because the inner portion of the airtight envelope is maintained at the degree of vacuum of about $10^{-6}$ [Torr], the spacers 20 are provided as withstanding atmospheric pressure structural members in order to prevent the breakage of the airtight envelope due to the atmospheric pressure, an unexpected impact, or the like.

The substrate 11 is fixed onto the rear plate 15. N×M cold cathode devices 12 are formed on the substrate 11. Note that N and M each denote a positive integer equal to or larger than 2 and are set as appropriate according to the number of target display pixels. For example, in the case of a display device for high quality television display, it is desirable that N is set to 3000 or more and M is set to 1000 or more. The N×M cold cathode devices 12 are wired in passive matrix by M row-directional wirings 13 and N column-directional wirings 14. A portion which is composed of the substrate 11, the cold cathode devices 12, the row-directional wirings 13, and the column-directional wirings 14 is called a multi-electron beam source.

If the multi-electron beam source used for the image display device of the present invention is an electron source in which the cold cathode devices are wired in passive matrix, there are no limitations regarding a material and a shape of the cold cathode device and a method of manufacturing the cold cathode device. Accordingly, for example, the surface conduction electron-emitting device, the FE-type device, or the MIM device can be used as the cold cathode device.

Also, the metal back 19 which is known in a CRT field is provided on the surface of the fluorescent film 18 on the rear plate 15 side.

Next, a structure of a multi-electron beam source in which the surface conduction electron-emitting devices are arranged as the cold cathode devices on a substrate and wired in passive matrix will be described.

Figure 5:
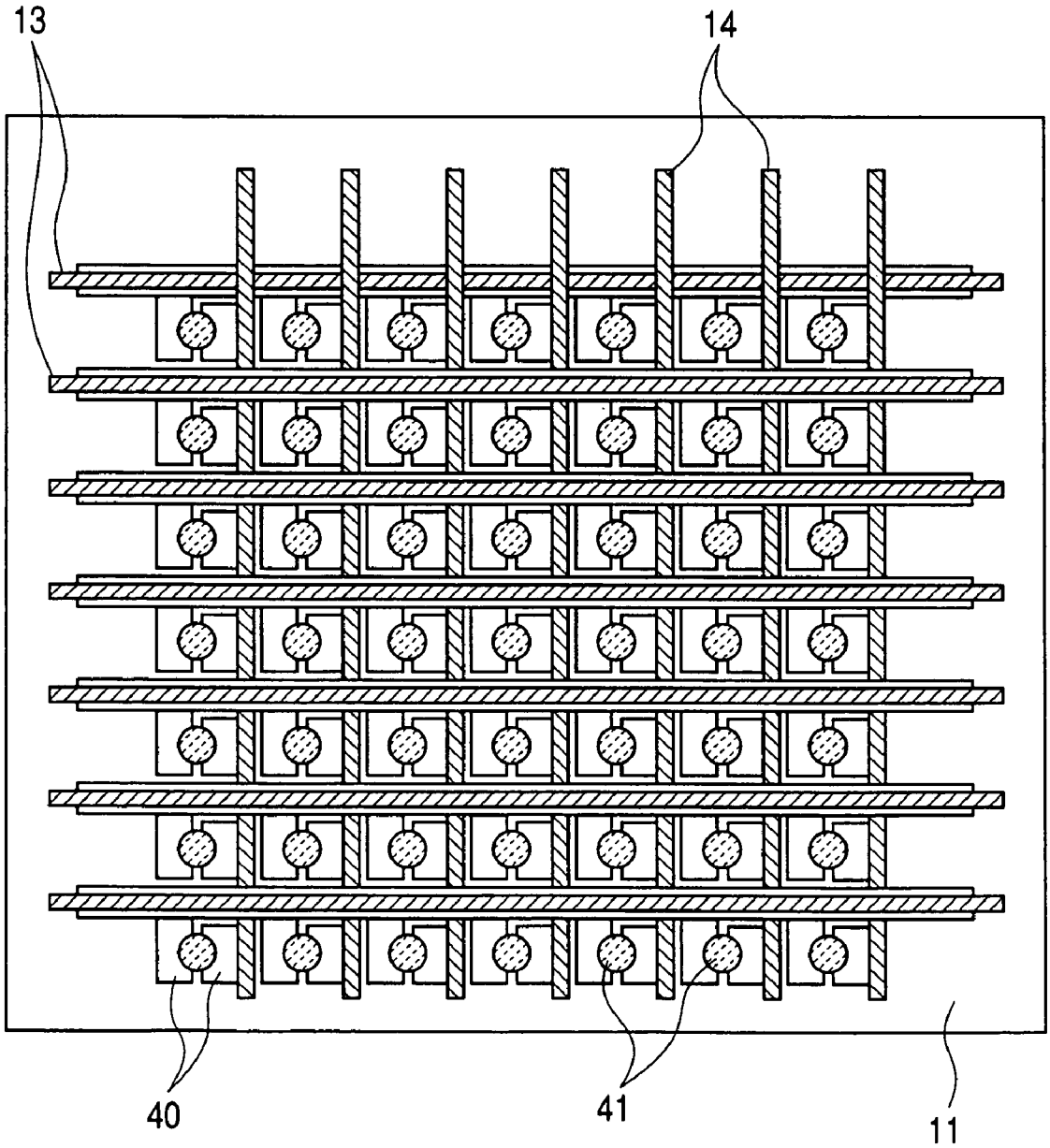
FIG. 5 is a plan view showing a multi-electron beam source of the image display device using the spacers according to the present invention.

FIG. 5 is a plan view showing the multi-electron beam source used for the display panel shown in FIG. 4. The surface conduction electron-emitting devices are arranged on the substrate 11 and wired in passive matrix by the row-directional wiring electrodes 13 and the column-directional wiring electrodes 14. Note that reference numerals 13 and 14 denote electrodes. An insulating layer (not shown) is formed between the row-directional wiring electrodes 13 and the column-directional wiring electrodes 14 at the intersection portions therebetween, thereby keeping electrical insulation.

The multi-electron beam source having the above-mentioned structure is manufactured as follows. The row-directional wiring electrodes 13, the column-directional wiring electrodes 14, the interelectrode insulating layer (not shown), and device electrodes 40 and a conductive thin film 41 which compose each of the surface conduction electron-emitting devices are formed in advance on the substrate 11. After that, a current is caused to flow in each of the surface conduction electron-emitting devices through the row-directional wiring electrodes 13 and the column-directional wiring electrodes 14 to perform energization forming operation and energization activation operation.

In this embodiment mode, a structure in which the substrate 11 for the multi-electron beam source is fixed onto the rear plate 15 of the airtight envelope is used. In the case where the substrate 11 for the multi-electron beam source has a sufficient strength, the substrate 11 for the multi-electron beam source itself may be used as the rear plate 15 of the airtight envelope.

Figure 6A:
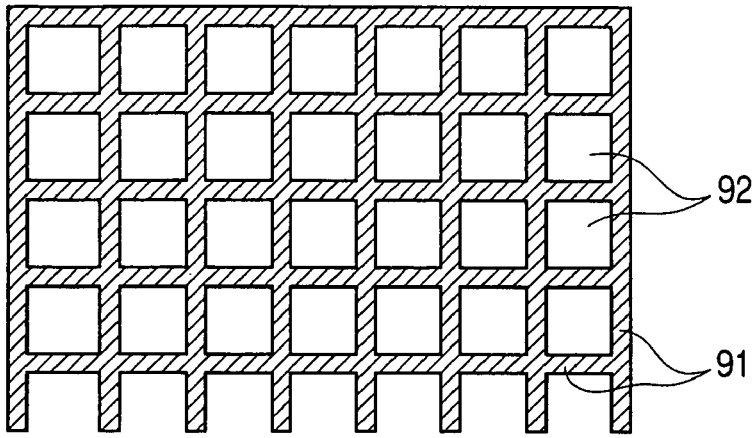
FIGS. 6A and 6B are sectional views showing an arrangement of phosphors on a face plate of the image display device using the spacers according to the present invention.
Figure 6B:
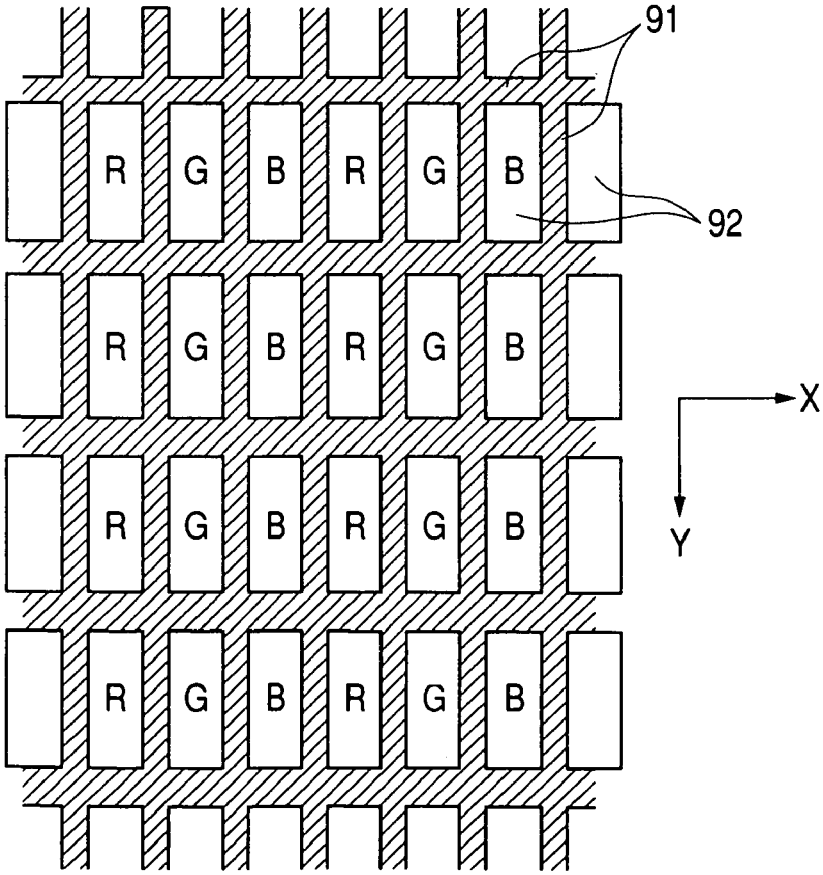

FIGS. 6A and 6B are explanatory views of the fluorescent film provided on the face plate.

FIG. 6A is a schematic view of the fluorescent film and FIG. 6B is an enlarged view thereof. Phosphors 92 of R, G, and B, which are surrounded by a black conductor 91 are arranged.

(Spacer)

Next, a structure of the spacer and a spacer manufacturing method will be described with reference to a specific example.

Figure 7:
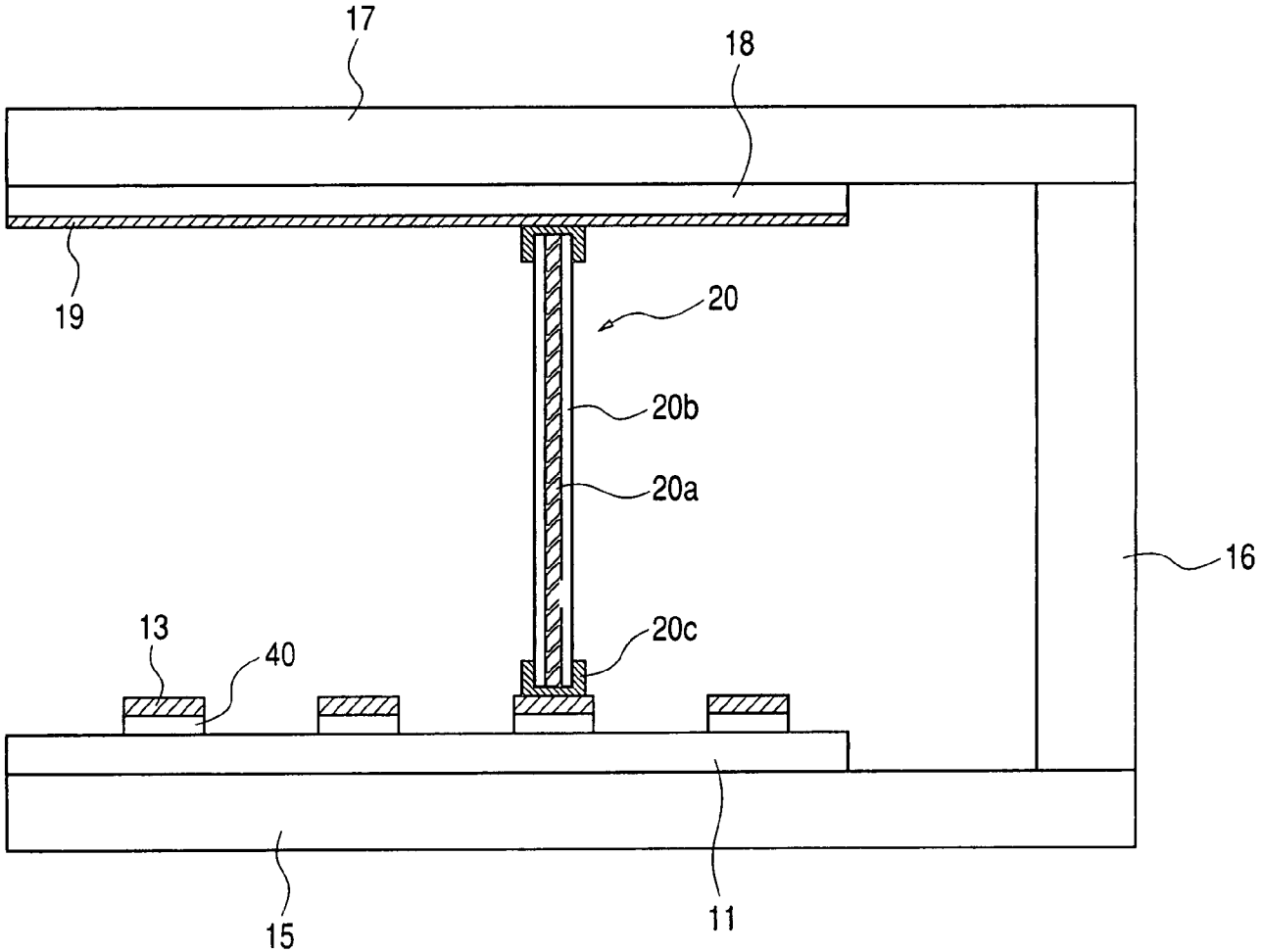
FIG. 7 is a sectional view taken along the line 7-7 of FIG. 4, showing a display panel of the image display device using the spacers according to the present invention.
Figure 8:
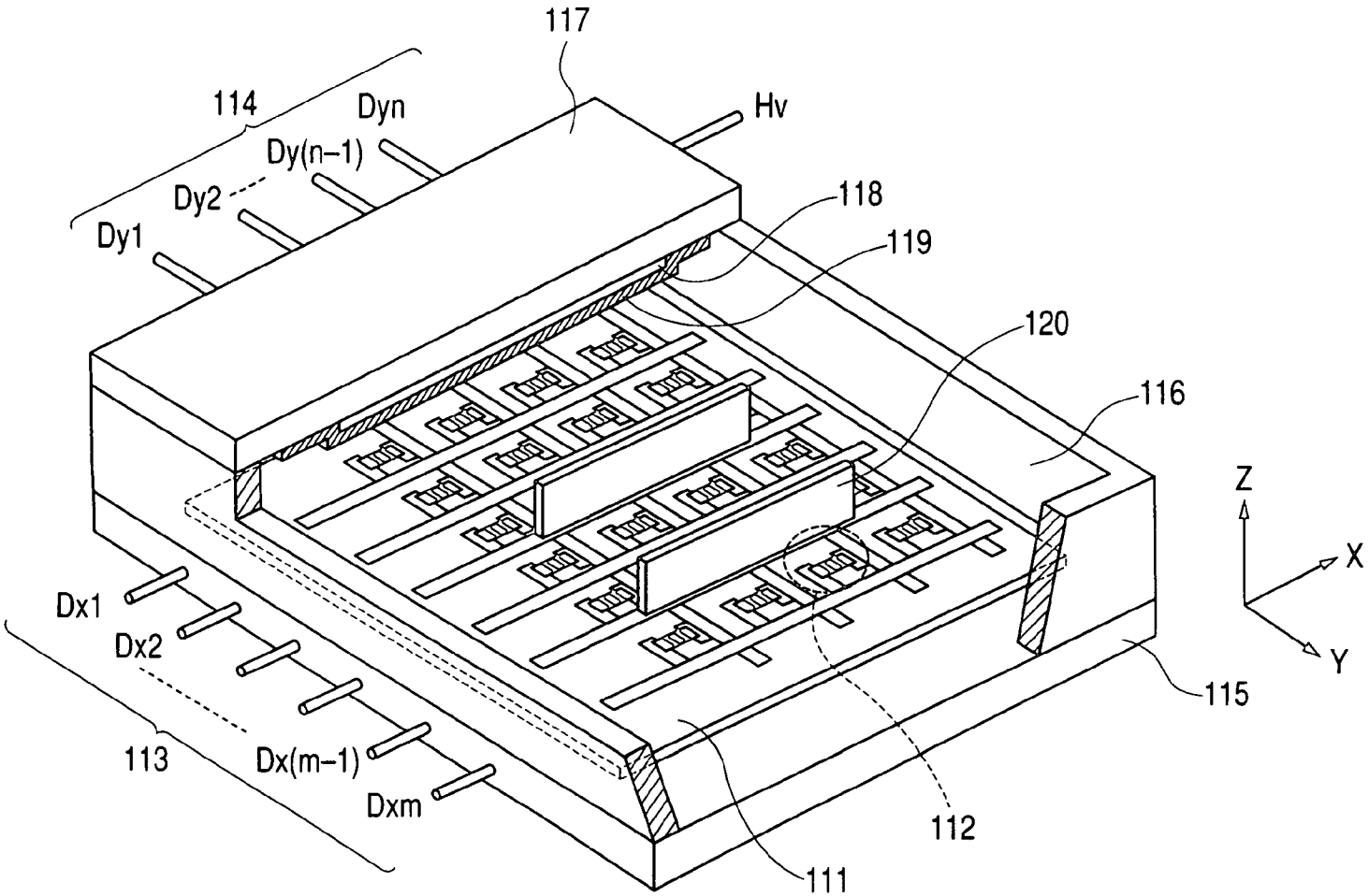
FIG. 8 is a perspective view showing a display panel of a conventional image display device, in which a portion of the display panel is cut.

FIG. 7 is a schematic sectional view taken along the line 7-7 of FIG. 4. Reference numerals of the respective members correspond to those in FIG. 4. In order to improve a charging protection effect, a high resistance film 20*b* is formed on each of the spacers 20. In order to meet the above-mentioned purpose, the required number of spacers 20 are arranged at required intervals. As for the structure described here, each of the spacers 20 is formed in a thin plate shape. In addition, the spacers 20 are arranged in parallel with the row-directional wirings 13 and electrically connected with the row-directional wirings 13.

It is desirable that the spacers 20 have an insulating property which is resistant to a high voltage applied between the row-directional wirings 13 and the column-directional wirings 14 which are formed on the substrate 11 and the metal back 19 which is formed above the inside surface of the face plate 17. In addition, it is desirable that the spacers 20 have the conductivity to such a degree as to prevent charging onto the surfaces of the spacers 20. This is because, if the spacers 20 are charged, the electrons flying near the spacers 20 are attracted to the spacers 20, thereby causing a distortion on a display image in the vicinities of the spacers 20.

Examples of an insulating member 20*a* of the spacer 20 include quartz glass, glass from which a content of impurities such as Na is reduced, soda lime glass, and a ceramic member such as alumna. Note that, as the insulating member 20*a*, a material is preferable which has a coefficient of thermal expansion which is approximate to those of an airtight envelope and a material forming the substrate 11.

An electric current, which is found by dividing an acceleration voltage Va applied to the face plate 17 (metal back 19 etc.) on the high potential side by a resistance value Rs of the high resistance film, is caused to flow to the high resistance film 20*b* constituting the spacer 20. Thus, the resistance value Rs of the spacer 20 is set to a desirable range taking into account prevention of charging and power consumption. From the viewpoint of the prevention of charging, a sheet resistance R/square is preferably $10^{14}$ [Ω/square] or less. The sheet resistance R/square is more preferably $10^{13}$ [Ω/square] or less in order to obtain a sufficient charging protection effect. A lower limit of the sheet resistance is preferably $10^{7}$ [Ω/square] or more although it depends upon a shape of the spacer and a voltage applied between the spacers.

A thickness t of the high resistance film formed on the insulating material is desirably in a range of 10 [nm] to 1 [μm]. In general, in the case in which the film is so thin that film thickness t is 10 [nm] or less, the high resistance film is unstable in resistance and poor in reproducibility because it is formed in an island shape although depending upon a surface energy of a material, adhesion with the substrate, and a temperature of the substrate. On the other hand, in the case in which the film thickness t is 1 [μm] or more, it is more likely that the film is peeled off because of bigger film stress. Further, it takes a longer period of time for forming a film, which leads to poor productivity. Thus, the film thickness t is preferably 50 [nm] to 500 [nm].

Assuming that the sheet resistance R/square is ρ/t, the resistivity ρ of the high resistance film is preferably in a range of 0.1 [Ω cm] to $10^{8}$ [Ω cm] judging from the above-mentioned preferable ranges of the sheet resistance R/square and the film thickness t. Moreover, in order to realize the preferable ranges of the surface resistance and the film thickness, it is better to set the resistivity ρ within a range of $10^{2}$ to $10^{6}$ [Ω cm].

As described above, in the case where a current flows into the high resistance film formed on the spacer 20 or in the case where the entire display device produces heat during the operation, the temperature of the spacer 20 increases. If the temperature coefficient of resistance of the high resistance film is a large negative value, as the temperature increases, the resistance value decreases and a current flowing into the spacer 20 increases. Therefore, the temperature further increases. Then, the current keeps increasing until it exceeds the limitation of the power source. A value of the temperature coefficient of resistance with which such an out-of-control of the current is caused is experimentally a negative value and the absolute value is 1% or more. That is, it is desirable that the temperature coefficient of resistance of the high resistance film is less than −1%.

As a material of the high resistance film, metal oxides are superior. Among the metal oxides, oxides of chromium, nickel, and copper are preferable materials. This is supposedly because these oxides have a relatively low emission efficiency of a secondary electron and are hardly charged even if an electron emitted from the electron-emitting device collides against the spacer. As a material other than the metal oxides, carbon is preferable because it has a low emission efficiency of a secondary electron. In particular, amorphous carbon is preferable because it has a high resistance and a resistance of the spacer is easily controlled to a desired value.

However, the above metal oxides and carbon have resistance values which can be hardly adjusted to a preferable range of the resistivity desired for the high resistance film. In addition, resistances of the metal oxides and carbon easily fluctuate depending on an atmosphere. Therefore, the resistance cannot be sufficiently controlled only with those materials. A nitride of aluminum and transition metal alloy are preferable because a resistance value of them can be controlled in a wide range from that of a highly conductive body to that of an insulating body by adjusting a composition of the transition metal. Moreover, such a nitride has a relatively small variation of a resistance value in a manufacturing process of a display device discussed later and is a stable material. In addition, the nitride has a temperature coefficient of resistance lower than −1% and is a material which is practically easy to use. Examples of a transition metal element include Ti, Cr, and Ta.

The alloy nitride film is formed on an insulating member by a thin film forming method such as sputtering, reactive sputtering in a nitrogen gas atmosphere, electron beam evaporation, ion plating, or an ion assist evaporation method. The metallic oxide film can be also formed by the same thin film forming method. In this case, an oxygen gas is used instead of a nitrogen gas. In addition, the metallic oxide film can be formed by using a CVD method or an alkoxide applying method. The carbon film is formed by an evaporation method, a sputtering method, a CVD method, or a plasma CVD method. In particular, in the case where the amorphous carbon film is formed, hydrogen is contained in an atmosphere for film formation or a hydrocarbon gas is used as a film formation gas.

Thus, the structure of the spacer used for the flat display device is described. However, the present invention is not limited to this and the structure of the spacer can be used for other applications.

Hereinafter, another image display device using a display device will be described in more detail.

Reference symbols Dx1 to Dxm, Dy1 to Dyn, and Hv denote electrical connection terminals which are made using the airtight structure and provided to electrically connect the display panel with electrical circuits (not shown). The terminals Dx1 to Dxm are electrically connected with the row-directional wirings 13 of the multi-electron beam source. The terminals Dy1 to Dyn are electrically connected with the column-directional wirings 14 of the multi-electron beam source. The terminal Hv is electrically connected with the metal back 19 of the face plate 17.

Also, the inner portion of the airtight envelope is exhausted to produce a vacuum. That is, after the airtight envelope is assembled, an exhaust pipe and a vacuum pump (not shown) are connected with each other and then the inner portion of the airtight envelope is exhausted up to a degree of vacuum of about $10^{-7}$ [Torr]. After that, the exhaust pipe is sealed. In order to maintain the degree of vacuum in the airtight envelope, a getter film (not shown) is formed at a predetermined position in the airtight envelope immediately before sealing or after sealing. The getter film is, for example, a film which is formed by heating a getter material mainly containing Ba for evaporation by a heater or a high frequency heating unit. The inner portion of the airtight envelope is maintained at the degree of vacuum of $1\times10^{-5}$ [Torr] to $1\times10^{-7}$ [Torr] by an adsorption action of the getter film.

When voltages are applied to the respective cold cathode devices 12 through the external envelope terminals Dx1 to Dxm and Dy1 to Dyn, electrons are emitted from the respective cold cathode devices 12. Simultaneously with this, a high voltage of several hundred volts to several kilovolts is applied to the metal back 19 through the external envelope terminal Hv to accelerate the emitted electrons, so that the electrons collide with the inside surface of the face plate 17. Thus, the respective color phosphors composing the fluorescent film 18 are excited to emit lights, thereby displaying an image.

In general, an applied voltage to the surface conduction electron-emitting device 12 of the present invention which is the cold cathode device is about 12 [V] to 16 [V]. A distance d between the metal back 19 and the cold cathode device 12 is about 0.1 [nm] to 8 [nm]. A voltage applied between the metal back 19 and the cold cathode device 12 is about 0.1 [kV] to 10 [kV].

Thus, the outlines regarding the basic structure of the display panel, the method of manufacturing the display panel, and the image display device using the display panel, according to the embodiment modes of the present invention has been described.

Hereinafter, the present invention will be described in more detail with reference to embodiments.

In the respective embodiments described below, there is used the multi-electron beam source of the above-mentioned type, in which N×M (N=720 and M=240) surface conduction electron-emitting devices each of which includes an electron-emitting region in a conductive particle film between device electrodes are wired in matrix by M row-directional wirings and N column-directional wirings as the multi-electron beam source.

Embodiment 1

In this embodiment, a display panel corresponding to the first embodiment mode is manufactured.

A glass which has a length of 200 [nm], a width of 5 [nm], and a thickness of 0.2 [nm] and is the same as the glass for the rear plate 15 is prepared for an insulating member 20*a* of each of spacers. As for a high resistance film, simultaneous sputtering using targets of W and Ge is conducted in an atmosphere in which argon and nitrogen are mixed with each other by a sputtering apparatus, so that a nitride film containing W and Ge is laminated at a thickness of 200 [nm]. A resistivity of the formed nitride film containing W and Ge is $5.0\times10^{5}$ [Ωm]. Next, low resistance films (electrodes) are formed on the surface of each of the spacers 20 which is in contact with the rear plate 15 and the surface of each of the spacers 20 which is in contact with the face plate 17.

Here, the low resistance films are used to electrically connect the high resistance film 20*b* with the face plate 17 (metal back 19 and the like) which is located on a high potential side and the substrate 11 (wirings 13 and 14 and the like) which is located on a low potential side.

A material having a resistance value sufficiently lower than that of the high resistance film 20*b* may be selected for the low resistance film 20*c*. Accordingly, the material is appropriately selected from a metal such as Ni, Cr, Au, Mo, W, Pt, Ti, Al, Cu, or Pd, an alloy of those, a printed conductor which is composed of a metal such as Pd, Ag, or Au, a metal oxide such as $RuO_2$, or an alloy such as Pd—Ag, glass, etc. a transparent conductor such as $In_2O_3$—$SnO_2$, a semiconductor material such as polysilicon, and the like. The spacers are connected with the X-directinal wirings and the metal back 19 on the face plate 17.

A method of manufacturing the display panel in this embodiment is similar to the method described above with reference to FIG. 4 and therefore the detailed description is omitted. Note that the spacers 20 are fixed onto the row-directional wirings 13 (300 [μm] in line width) of the substrate 11 at regular intervals in parallel with the row-directional wirings 13 by the method described above with reference to FIGS. 1A to 1E. Here, the tension applied to the spacers 20 is set to 2.8±0.3 [N]. As a result, an assembly accuracy of each of the spacers 20 is ±20 [μm]. After that, the face plate 17 in which the fluorescent film 18 and the metal back 19 are provided on the inside surface is located 5 [nm] above the substrate 11 through the side wall 16. Respective bonding portions among the rear plate 15, the face plate 17, and the side wall 16 are fixed.

Therefore, in the image display device using the thus completed display panel as shown in FIG. 4, a scanning signal and a modulation signal are applied from a signal generating unit (not shown) to each of the cold cathode devices (surface conduction electron-emitting devices) 12 through the external envelope terminals Dx1 to Dxm and Dy1 to Dyn to emit electrons. A high voltage is applied to the metal back 19 through the high voltage terminal Hv to accelerate the emitted electron beams. Then, the electrons collide with the fluorescent film 18, so that respective color phosphors 92 (R, G, and B in FIGS. 6A and 6B) are excited and emit lights, thereby displaying an image. Note that an applied voltage Va to the high voltage terminal Hv is set to 3 [kV] to 10 [kV] and an applied voltage Vf between the respective wirings 13 and 14 is set to 14 [V].

At this time, light emission spot arrays including light emission spots due to the emitted electrons from the cold cathode devices 12 located near the spacers 20 are two-dimensionally produced at regular intervals. Accordingly, a color image which is sharp and has preferable color reproducibility can be displayed.

Embodiment 2

A display device having the same structure as that of Embodiment 1 above is produced. At this time, each of the spacers 20 has the auxiliary support members 6 in both ends thereof. In addition, the spacers 20 are provided to the rear plate 15 by the method described above with reference to FIGS. 2A to 2E. The other structure is identical to that of Embodiment 1. In this embodiment, as in Embodiment 1, light emission spot arrays including light emission spots due to the emitted electrons from the cold cathode devices 12 located near the spacers 20 are two-dimensionally produced at regular intervals. Accordingly, a color image which is sharp and has preferable color reproducibility can be displayed.

Embodiment 3

A display device having the same structure as in Embodiment 1 above is produced. At this time, each of the spacers 20 has the auxiliary support members 6 in both ends thereof. In addition, the spacers 20 are provided to the rear plate 15 by the method described above with reference to FIGS. 3A to 3F. The other structure is identical to that in Embodiment 1. In this embodiment, as in Embodiment 1, light emission spot arrays including light emission spots due to the emitted electrons from the cold cathode devices 12 located near the spacers 20 are two-dimensionally produced at regular intervals. Accordingly, a color image which is sharp and has preferable color reproducibility can be displayed.

As described above, according to the present invention, the spacers are easy to locate and a displacement of each of the spacers can be prevented to improve the assembly accuracy. Thus, an envelope or an electron beam apparatus for an image display device can be manufactured at a low cost. In addition, a preferable display image can be obtained in the image display device using the envelope or the electron beam apparatus, which is manufactured by the method of the present invention.

What is claimed is:

1. A method of manufacturing an electron beam apparatus which includes a first substrate having a plurality of electron-emitting devices on a surface thereof, a second substrate which is opposed to the first substrate and in which an electrode that controls electrons emitted from the plurality of electron-emitting devices is formed, and at least one space defining member which is located between the first substrate and the second substrate has a plate shape, the method comprising steps of:

applying a tension to the space defining member; and bonding the space defining member to which the tension is applied to the first substrate through a plurality of bonding points spaced from each other, wherein, in the step of bonding the space defining member to the first substrate, the plurality of bonding points spaced from each other are positioned inside between points at which the tension is exerted in the step of applying the tension.

2. The method according to claim 1, wherein in the step of applying the tension, the tension is applied by a spacer conveying unit.

3. The method according to claim 1, wherein in the step of applying the tension, the tension is applied by a tension applying unit.

4. The method according to claim 1, wherein the space defining member has a base of an insulating property.

5. The method according to claim 1, wherein the space defining member has a surface on which a high resistance film is formed.

6. The method according to claim 5, wherein the high resistance film has a sheet resistance of $10^7$ to $10^{14}$ Ohms per square.

7. The method according to claim 1, wherein the first substrate further includes a plurality of wirings that electrically connect the plurality of electron-emitting devices and the at least one space defining member is located on at least one wiring.

* * * * *

UNITED STATES PATENT AND TRADEMARK OFFICE

CERTIFICATE OF CORRECTION

PATENT NO. : 7,249,989 B2
APPLICATION NO. : 11/418026
DATED : July 31, 2007
INVENTOR(S) : Akira Hayama It is certified that error appears in the above-identified patent and that said Letters Patent is hereby corrected as shown below:

ON COVER PAGE AT (57) ABSTRACT

Line 8, “kept” should read --keep--.

COLUMN 10

Line 52, “be also” should read --also be--.

COLUMN 11

Line 42, “0.1 [nm] to 8 [nm].” should read --0.1 [mm] to 8 [mm].--;
Line 65, “200 [nm],” should read --200 [mm],--; “5 [nm],” should read --5 [mm],--; and
Line 66, “0.2 [nm]” should read --0.2 [mm]--.

COLUMN 12

Line 39, “5 [nm]” should read --5 [mm]--.

COLUMN 14

Line 17, “wherein” should read --wherein,--; and
Line 20, “wherein” should read --wherein,--.

Signed and Sealed this

Twenty-ninth Day of April, 2008

JON W. DUDAS
*Director of the United States Patent and Trademark Office*